US008820619B2

(12) United States Patent
James et al.

(10) Patent No.: US 8,820,619 B2
(45) Date of Patent: Sep. 2, 2014

(54) PAPERBOARD CONTAINER FOR APPLICATION TO A BED RAIL

(75) Inventors: Donald L. James, Rolla, MO (US); John R. Pritchett, Rolla, MO (US); Robert T. Pritchett, Rolla, MO (US)

(73) Assignee: Bedside Safety Aid, Inc., Rolla, MO (US)

( * ) Notice: Subject to any disclaimer, the term of this patent is extended or adjusted under 35 U.S.C. 154(b) by 759 days.

(21) Appl. No.: 12/927,706

(22) Filed: Nov. 22, 2010

(65) Prior Publication Data

US 2011/0155795 A1 Jun. 30, 2011

Related U.S. Application Data

(63) Continuation-in-part of application No. 12/009,369, filed on Jan. 18, 2008, now abandoned.

(60) Provisional application No. 60/881,976, filed on Jan. 22, 2007.

(51) Int. Cl.
*B65D 25/04* (2006.01)

(52) U.S. Cl.
USPC ..... 229/120.31; 220/6

(58) Field of Classification Search
USPC ..... 211/10, 72, 126.16, 132.1, 135, 195, 211/126.5, 126.6, 88.02, 88.01, 88.03, 75, 211/73; 229/117.12, 120.37, 120.33, 229/117.09, 120.02, 141, 144, 145, 152, 229/153, 155, 159; 206/460, 806; 220/6
See application file for complete search history.

(56) References Cited

U.S. PATENT DOCUMENTS

| | | | | |
|---|---|---|---|---|
| 1,407,073 | A | 2/1922 | Lyons | |
| 1,915,958 | A * | 6/1933 | Skirrow | 248/300 |
| 2,174,715 | A | 10/1939 | Baker | |
| 2,640,644 | A | 6/1953 | Hennessey et al. | |
| 2,770,411 | A | 11/1956 | MacKay | |
| 2,770,513 | A | 11/1956 | Brown | |
| D185,897 | S | 8/1959 | Stark | |
| 3,027,064 | A | 3/1962 | Thomas | |
| 3,193,108 | A | 7/1965 | Johnson | |
| 3,881,649 | A * | 5/1975 | Krautsack | 229/117.12 |
| 3,895,605 | A * | 7/1975 | Goldman | 119/245 |
| 3,945,559 | A * | 3/1976 | Krautsack | 229/100 |
| 3,999,662 | A | 12/1976 | Barnhardt | |
| D257,993 | S | 1/1981 | DeMars | |
| 4,753,341 | A * | 6/1988 | McIntyre | 211/130.1 |
| 4,938,415 | A * | 7/1990 | Walker et al. | 229/120.29 |
| 4,951,867 | A | 8/1990 | McManus | |
| 5,322,172 | A | 6/1994 | Maglione | |
| 5,836,455 | A | 11/1998 | Connor et al. | |
| 5,984,120 | A * | 11/1999 | Johnske | 211/132.1 |
| 6,557,711 | B2 | 5/2003 | Grueneberg | |
| 2005/0081860 | A1 | 4/2005 | Gonzales | |

* cited by examiner

*Primary Examiner* — Joshua Rodden
*Assistant Examiner* — Stanton L Krycinski
(74) *Attorney, Agent, or Firm* — Paul M Denk

(57) ABSTRACT

A foldably assembleable generally rectangularly-shaped box-like container with spaced lateral and longitudinal walls where one longitudinal wall has a greater height and has two hooks, or folds into a hook-like shape, for placing the container upon a bed rail. The container preferably has dividers that divide the interior into compartments for storage of things therein and which also stiffen the container. Optional stiffener box or shelf constructions may be employed to strengthen the container against collapse and to effect shallower compartments. The container can be foldably formed from one or two layers of material, often cardstock or cardboard.

10 Claims, 15 Drawing Sheets

9
8
14
14f
2
2a
2b
3
3a
4
4a
5
5c
5d
6
6a
6b
6f
7
7a
7b
7c

PAPERBOARD CONTAINER FOR APPLICATION TO A BED RAIL

CROSS REFERENCE TO RELATED APPLICATION

This non-provisional continuation-in-part patent application claims priority to the non-provisional patent application having Ser. No. 12/009,369, having filing date Jan. 18, 2008 now abandoned, and to provisional patent application having Ser. No. 60/881,976, having filing date Jan. 22, 2007, which are commonly owned by the same inventors.

FIELD OF THE INVENTION

This invention principally relates to a paperboard container, and its modifications, that may be suspended upon the rail of a hospital bed to provide for holding various personal and hospital items that can desirably be kept within close proximity to the patient.

BACKGROUND OF THE INVENTION

This invention relates generally to lightweight foldably expandable containers and to the material sheets from which they may be formed, and, more specifically, to a divided container with at least one hook portion for use upon a hospital bed.

The primary purpose of this paperboard container is for holding items near a hospital bed where individual items for patient safety and other objects may be located.

A person who occupies a hospital bed has certain items that are critical to his safety and comfort. These include the telephone, emergency suctioning equipment, the nurse call light, patient cell phone, and TV control, which are necessary for patient safety and comfort. These items are frequently inaccessible to the patient and reaching for them causes potential risk to the patient. These safety and personal care items are frequently under the sheets, have fallen to the floor, or have been misplaced beyond the patient's sight or reach. This invention solves this problem by providing a safe and convenient location for organization and accessibility of these items.

A person who occupies a hospital bed for a length of time brings objects along: pictures from home, pens and pencils, a flashlight, a book light, books, magazines, and the like. Additionally, well-wishers provide other objects to a patient in bed: flowers, bears, cards, balloons, and the like. In time, those objects accumulate in a small and busy hospital room. The objects may impede, or interfere, with health care providers as they move around the bed when tending to the patient.

For longer stays in a hospital, and also in a nursing home, the objects allow a person to establish an environment similar to home. Familiar objects lead to more pleasant feelings in a patient which assists in healing and safety in a nursing home resident which boosts morale and well being.

Objects have been managed in their original containers or wisely placed in a hospital room or around a bed. Bags and boxes have also collected and organized objects near a bed. Bags often have a wide mouth that accepts many objects and often have a handle that rests upon a bed handle, knob, peg, or extension. When hanging, the bag collects objects but limits access to its interior as the weight of objects narrows the opening to a bag when suspended from a handle or peg. Boxes, having a generally rectangular form, have a fixed shape that also accepts many objects. Boxes are often placed upon the floor or chairs adjacent to a hospital bed for holding various objects. Some boxes have a hole for a handle that can be placed upon a bed handle, knob, peg, or extension similar to a bag. However, boxes generally have an open top sometimes with adjacent flaps. Many objects fit into a box but the roominess leads to disorganization of objects therein. As a patient accumulates more objects near a hospital bed, efficient storage of the objects for ready retrieval by the patient becomes highly desirable.

SUMMARY OF THE INVENTION

The present invention, when foldably formed and expanded for use, has the shape of a generally rectangular, box-like container with lateral walls, longitudinal walls, a bottom, and dividers, with a hangar or hook portion for hanging the container upon a generally horizontally extending bed rail or like rail. In one preferred form, one longitudinal wall has a greater height than the other and is folded into a hook-like shape for locating the container upon the bed rail. Alternatively, in another preferred form, the longitudinal walls are similarly of unequal heights, with the shorter of the longitudinal walls having a pair of hinged hooks extending outwardly therefrom.

In one embodiment, the container may include a plurality of dividers that separate the interior of the container for storage of things therein. The dividers also stiffen the container when in use. In another embodiment, the invention may include one or more stiffener boxes or, alternatively, shelves, that are positionable within interior compartments to strengthen the container and to also effect interior compartments of shallower depths.

The container of the present invention can preferably be made from flat, stock material, such as cardstock or paperboard, that, when foldably formed into an assembled container, is generally and sufficiently stiff to be resistant to deformation when light pressure is applied thereto. The stock material may include thereon one or more templates that include various of the longitudinal and lateral walls and the bottom laid out and arranged on the stock material to define fold lines therebetween, along which fold lines the material can be folded to form the container. Preferably, the stock material is corrugated and double-sided cardboard, but may also be a single strength cardboard if such single strength cardboard is so folded to form double strength elements. Alternatively, other materials, such as various plastics or other materials, may also be options, provided such materials are foldable and the elements formed therefrom are at least of comparable stiffness and body as double strength cardboard elements.

For purposes of further discussion and reference herein, "double strength" should be considered to mean of a strength generally equivalent to that of double-sided corrugated cardboard or of single strength cardboard folded over to form a double strength element.

The principal object of this invention is therefore to provide a container that can hang from a bed rail in a hospital or nursing home setting.

It is another object of this invention to provide a container that, in some embodiments, can be divided for separate storage of items therein.

Another object of this invention is to provide a container the basic structure of which is made from a minimum of material, preferably, in one embodiment, from a single planar sheet of material.

Another object of this invention is to provide a container that is readily manufactured and is inexpensive to purchase by the consumers.

A further object of this invention is to provide a container with, in some embodiments, a shelf or a stiffener box located therein that maintains the container in an open position.

These and other objects may become more apparent to those skilled in the art upon review of the summary of the invention as provided herein. In addition, the invention will be better understood upon undertaking a study of the description of its preferred embodiments, in view of the drawings.

DESCRIPTION OF THE DRAWINGS

In referring to the drawings.

The same reference numerals refer to the same or similar parts throughout the various figures.

DESCRIPTION OF THE PREFERRED EMBODIMENT

Figure 1:
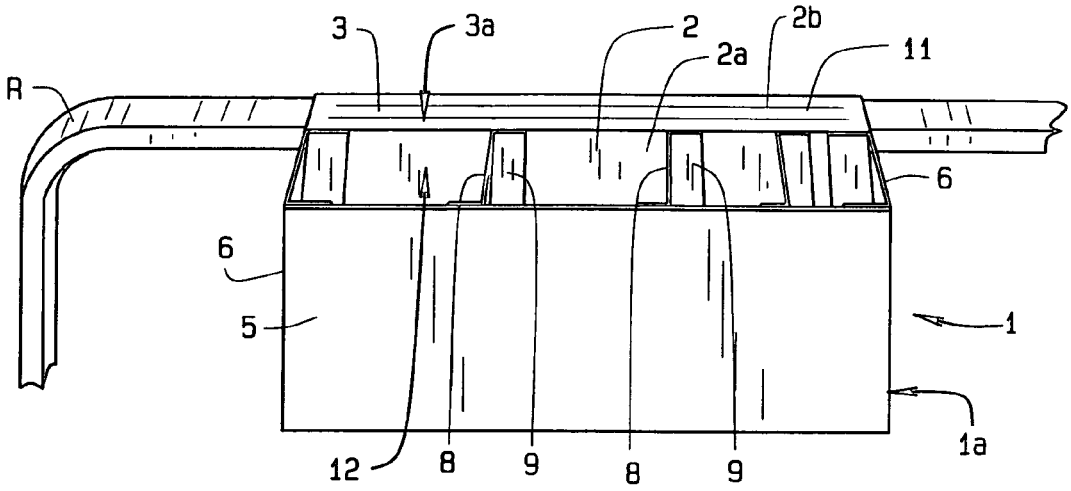
FIG. 1 is a front, perspective view of a preferred form of the formed container installed upon a bed rail.
Figure 2:
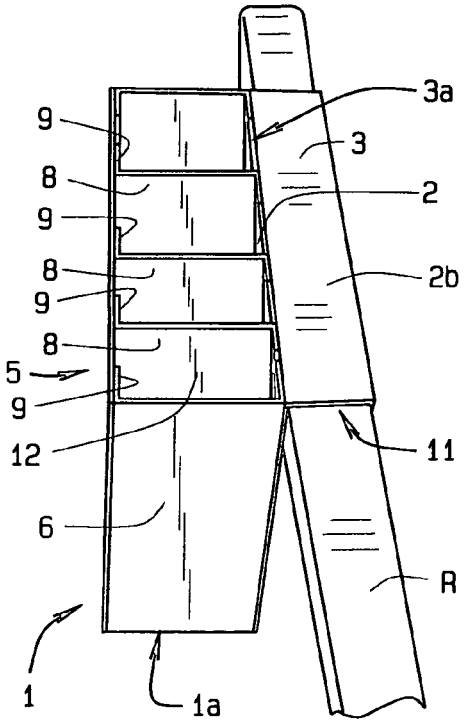
FIG. 2 is an end, perspective view of the installed container of FIG. 1.
Figure 3:
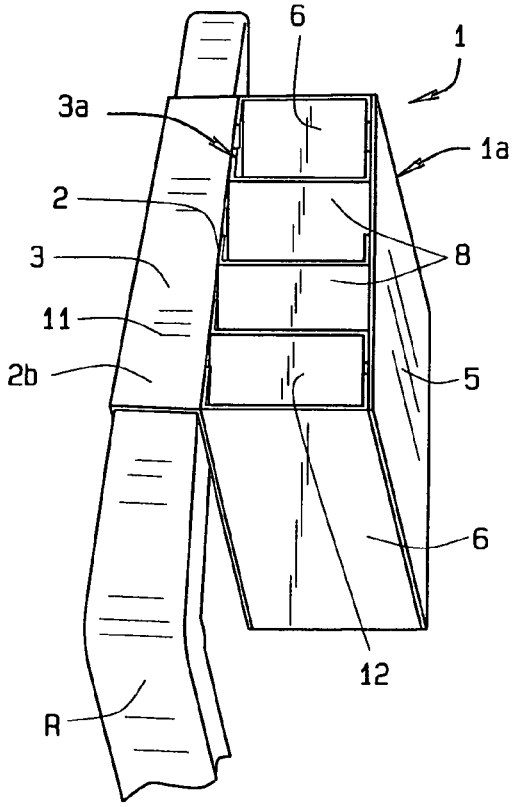
FIG. 3 is an opposite end, perspective view of the installed container of FIG. 1.

With reference to the drawings, FIGS. 1-3 show a preferred form of a formed container 1 according to the present invention as such container is disposed upon a bed rail or other generally horizontal rail R. The formed container includes a container base body portion 1*a*, sometimes hereinafter referred to the base container portion, as formed and expanded to assume a generally rectangular shape with two lateral walls 6, two longitudinal walls 2 and 5, and a bottom 7 (which is better seen in FIG. 4). As better shown in FIGS. 4-5, the first longitudinal, or inner, wall 2 has a lower wall portion 2*a* of a height generally equal to the height of the end walls 6 and an upper wall portion 2*b* that extends above the lower wall portion 2*a* for its entire length of the completed container. The upper wall portion 2*b* of inner wall 2 includes a shank portion 3, generally initially formed to be co-planar with the lower wall portion 2*a* of inner wall 2, but which is foldable outwardly from the base container portion 1*a* along a fold line 3*a* to be generally perpendicular to the lower portion 2*a* of inner wall 2, as better shown in FIGS. 1-3.

It should be understood that in addressing and discussing hereinabove and hereinafter the dimensions of various components, especially relative to other components, unless otherwise apparent within or from the context of discussion, the defined dimension of the component is generally considered to be the dimension of the formed component without taking into account any dimensional contribution arising or due to edge connector portions or the like, such as foldable end flaps for securing a given component to another component. Thus, for a formed component that has end flaps at opposed ends of a central portion for securing that component to different components, the defined length of such component is generally considered to be the length of the central portion. For a formed component that is formed by folding a base piece of material over itself to form such formed component, the defined height is generally considered to be the height of the resultant formed component rather than the height of the material piece prior to folding.

Figure 4:
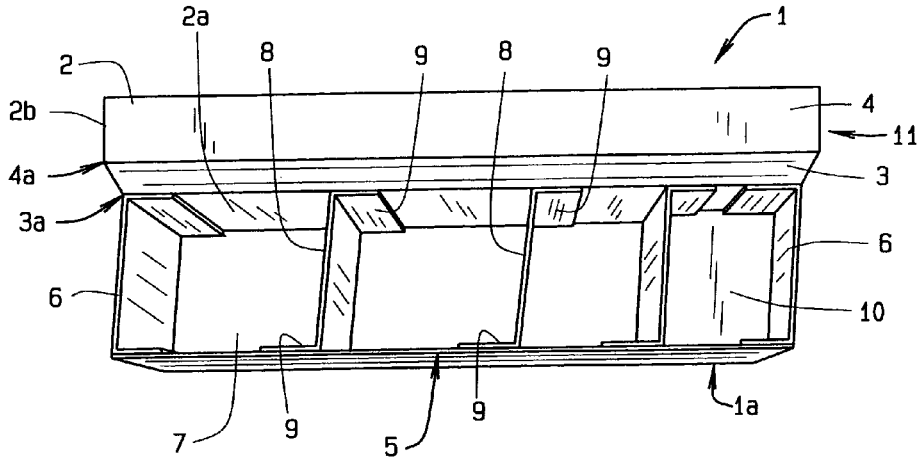
FIG. 4 is a top, perspective view of the container of FIG. 1, as partially formed and expanded, with the inner longitudinal wall shown only partially folded towards formation of the hangar portion of the container.
Figure 5:
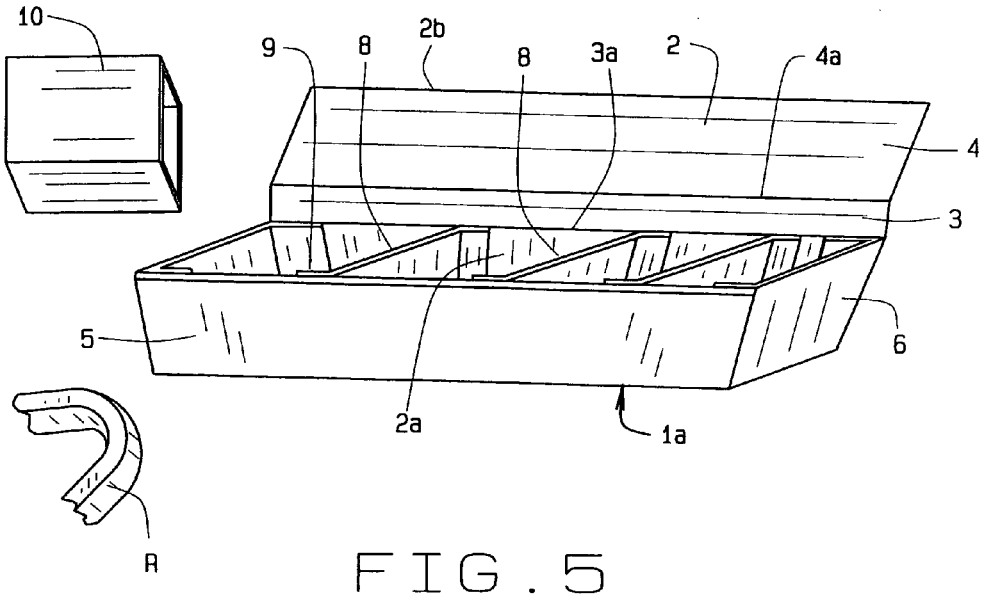
FIG. 5 is a front, perspective view of the container of FIG. 4, also showing a stiffener insert for insertion within a formed pocket or compartment within the container.
Figure 6:
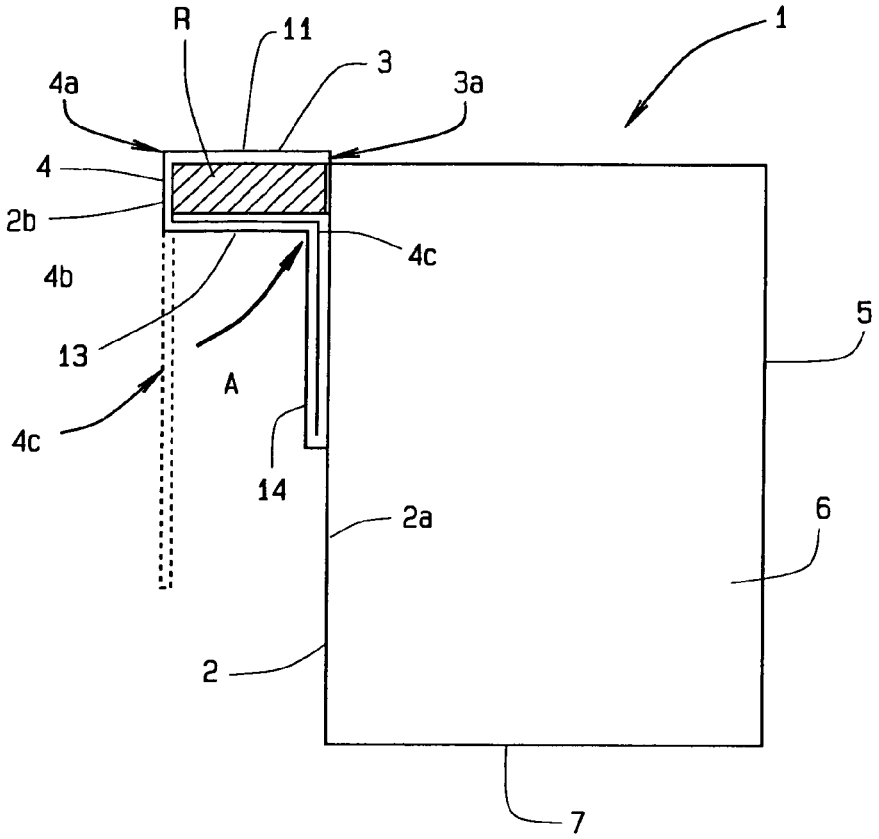
FIG. 6 is a plan, end view, similar to FIG. 3, but showing the manner in which the bight of the inner wall may wrap around the bed rail and connect to the outer surface of the inner wall to better secure the container on the bed rail.

As better seen from FIGS. 4-6, a bight 4 is disposed along the upper edge of the upper portion 2*b* of inner wall 2 between a further fold line 4*a* and the upper edge of inner wall 2. Bight 4 is foldable downwardly at fold line 4*a* such that the upper portion 2*b* of inner wall 2 thus forms a U-shaped hangar portion or hook 11, with the portion of shank 3 between fold lines 3*a* and 4*a* resting upon bed rail R and with the lower portion 2*a* of inner wall 2 and bight 4 extending along and down opposed sides of bed rail R generally parallel to one another, as shown in phantom in FIG. 6.

Preferably, the shank portion 3 between fold lines 3*a* and 4*a* is sized to be approximately the width of the bed rail R in order to achieve a secure fit upon the bed rail R. Typically, at least a portion of bight 4 extends downwardly to be generally parallel to the lower portion 2*a* of inner wall 2, although, as will be further explained hereinafter, an outer portion of the bight may be formed to wrap around the bed rail R for a tighter fit, as shown in FIG. 6. The shank and bight of the inner wall 2 thus co-operate as a hangar or hook to grasp bed rail R so that the container can be hung from such bed rail.

The base container portion also has an outer wall 5 disposed opposite inner wall 2, which outer wall has an overall height less than that of inner wall 2. For the embodiment of FIGS. 1-3, the height of outer wall 5 is approximately no greater than the height of the lower portion 2*a* of inner wall 2.

The lateral walls of the base container portion take the form of two mutually parallel and spaced apart end walls 6 that join the lower portion 2*a* of inner wall 2 to the outer wall 5. The end walls 6 and the outer wall 5 preferably have the same maximum height, typically no greater than that of the upper portion 2*b* of the inner wall 2, although the outer wall 5 may have a lower height than the lower portion 2*a* of the inner wall 2 and the end walls 6 may have a greater height, where they meet the inner wall 2, of approximately the height of lower wall portion 2*a* and a lower height, where they meet the outer wall 5, of approximately the height of the outer wall 5.

Below the end walls 6, the inner wall 2, and the outer wall 5, a bottom 7 closes the container. The bottom 7 has sufficient width to span across the container, at least the same width at the end walls 6.

Figure 7:
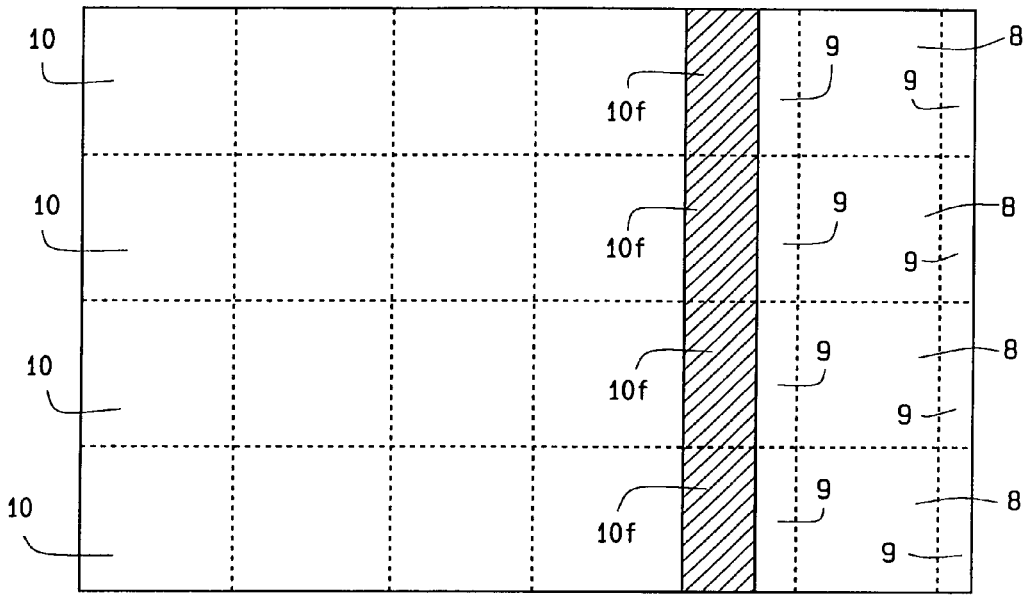
FIGS. 7 and 7*a* is a plan view of two sheets of cardboard of like size having thereon a typical layout from which a container base body portion may be formed by folding one of the cardboard sheets.
Figure 7A:
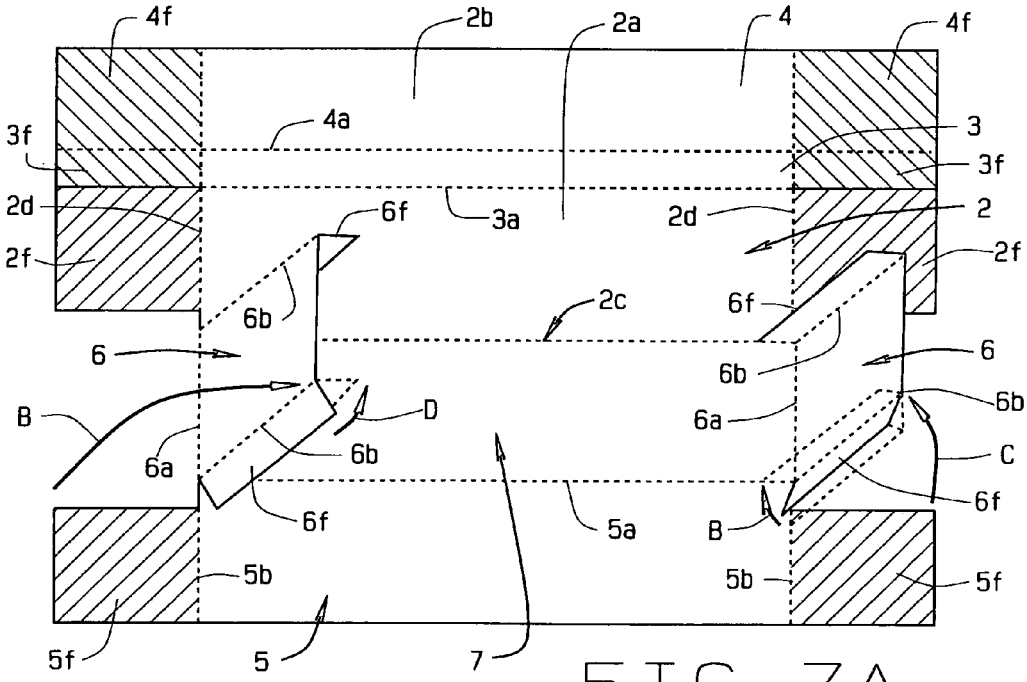

As will be further discussed hereinafter, in accordance with one preferred manner of assembly, the various walls of the base container portion 1*a* may be formed, as shown in FIG. 7, from a single sheet of a suitable material, such as double-sided corrugated cardboard, and such sheet, without separation of individual element portions therefrom, can be folded to foldably form and assemble the base container portion 1*a*, as will be further discussed hereinafter.

Figures 8, 8A, 8B:
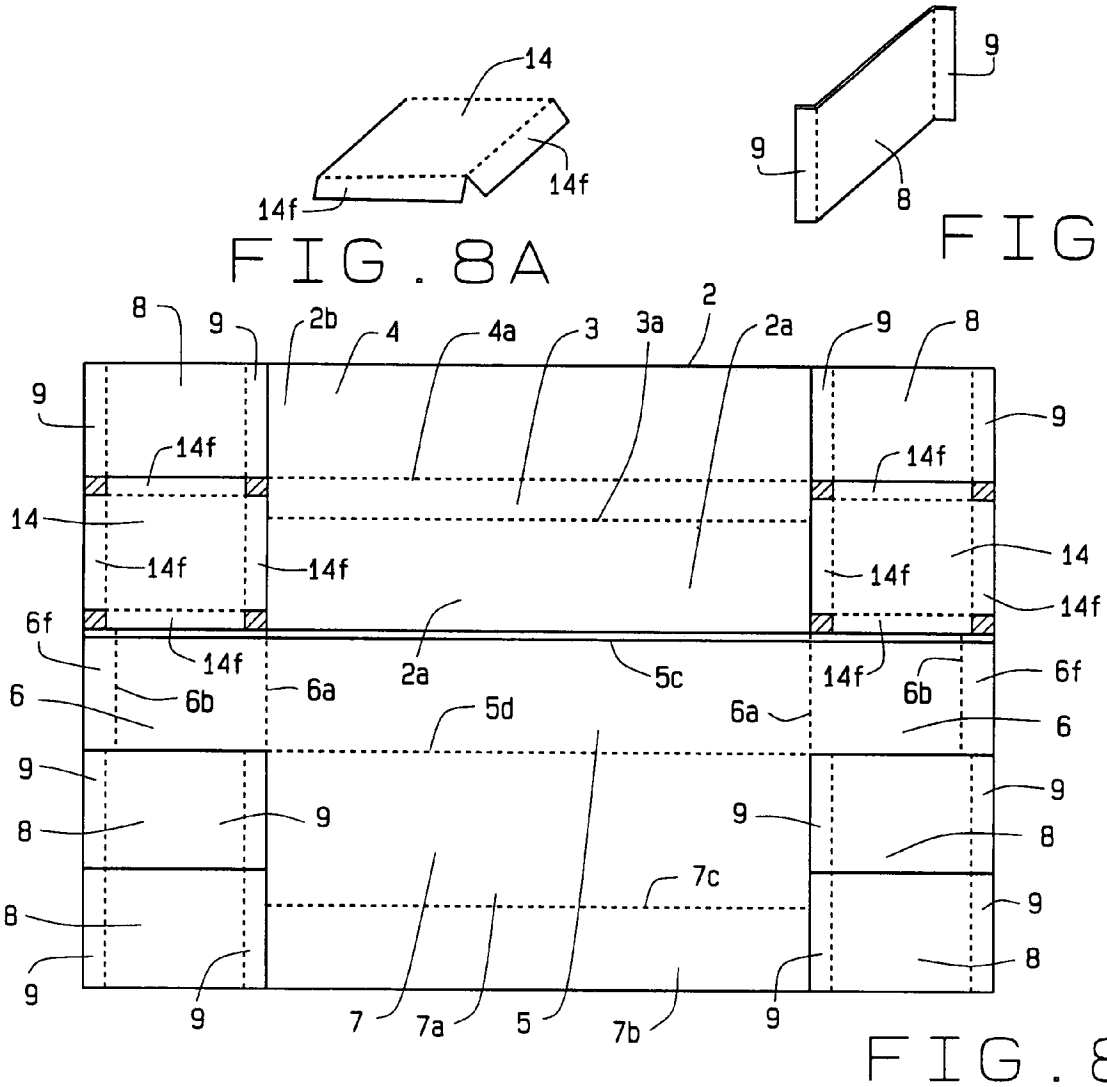
FIGS. 8, 8*a* and 8*b* is a plan view of a single sheet of cardboard showing a possible alternate layout for a container base body portion, and showing the divider and shelf.

For another preferred, but alternate, embodiment of the invention, the various walls of the base container portion 1*a* may likewise be formed from a single sheet of material. In accordance with such alternate embodiment of the invention, however, the walls are laid out on the material sheet, as shown in FIG. 8, to define separable portions that may be separated from one another and then folded and secured to one another to effect a partially assembled base container portion that may be flattened for storage, as shown FIG. 9

Figure 9:
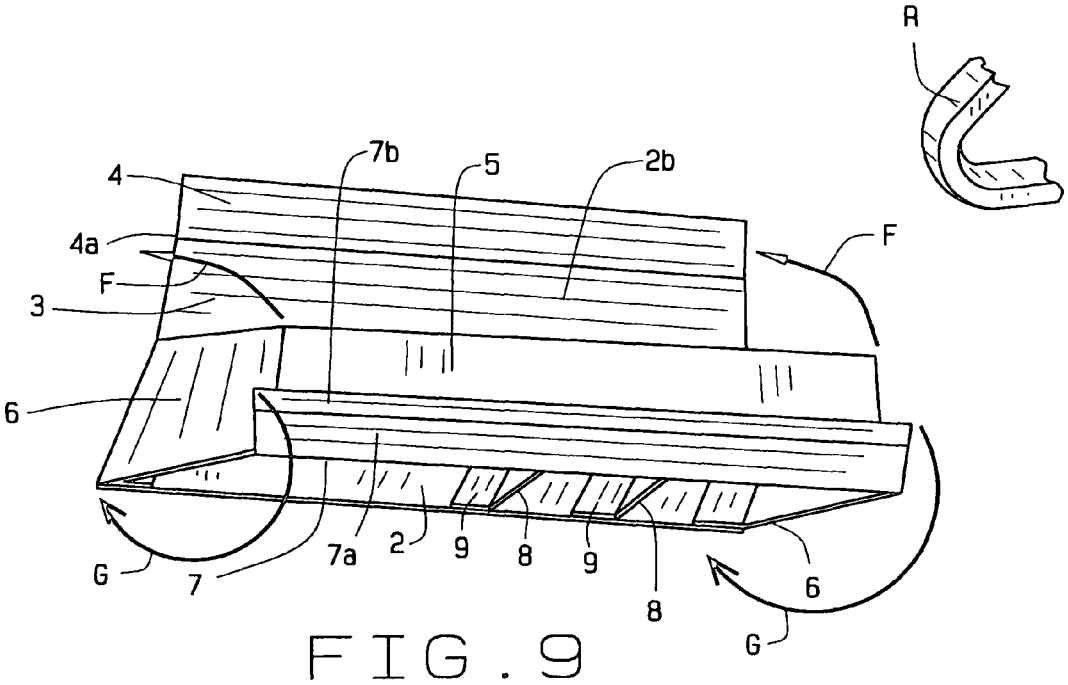
FIG. 9 is a perspective view of a partially assembled, partially flattened base container formed from the sheet of cardboard of FIG. 7.

For an alternate embodiment such as is depicted in FIG. 9, wherein the bottom 7 of a partially assembled, flattened base container portion 1*a* extends lengthwise along the outer wall 5, but in the opposite direction of the inner wall 2, the inner wall 2 may be laid out on the single sheet of material to be separable from another unitary portion of the sheet that includes layouts of the outer wall 5, the end walls 6, and the bottom 7. The wall layout portions of the separated material portions can be suitably folded and secured to one another to form a partial, flattened assembly for subsequent foldable expansion.

Preferably, without regard to the particular form of the container or its manner of assembly, one or more dividers 8 may be located within the base container portion to span from the inner wall 2 to the outer wall 5 to divide the interior of the formed container into a plurality of compartments 12. The dividers 8 are generally planar and rectangular, preferably including foldable end flaps 9 at the opposite ends thereof, with the central portion between the end flaps 9 having approximately the same length as the end wall 6. In the formed base container portion 1*a*, as shown in an expanded condition forming a formed container body portion, the dividers 8 are shown with the end flaps 9 folded to abut and be hingedly connected to the inner wall 2 and to the outer wall 5 to allow, as shown in FIG. 9, for collapsed storage and transportation of the base container portion 1*a* of the present invention. In several preferred embodiments, the hinged connection is provided by folding the end flaps 9 oppositely upon each divider 8. In the embodiments of FIGS. 1-5, the formed container is shown as having three dividers, although the number of dividers employed can be adjusted depending upon the length of the container.

Preferably, when the container is opened and ready for hanging, as in FIGS. 1-3, a stiffener box 10, as depicted in FIG. 5, may be placed in the compartments or pockets formed between a divider 8 and one end wall 6 or between two dividers 8. The stiffener box 10 will generally have at least four faces and a width similar to that of an end wall and a length similar to that of the compartment into which it is inserted so that it will fit snugly into that compartment and, using panel diaphragm action, help prevent racking and collapse of the unfolded container. The stiffener box 10 also reduces the depth of a compartment for storage of smaller things. In FIG. 4, the stiffener box 10 is shown placed in a compartment adjacent one end wall 6, although other locations are also foreseen. A user of the invention can relocate the stiffener box to the compartment of his or her choice.

When assembled, the container 1 is placed upon a bed rail R or other generally horizontal edge as shown in FIGS. 1-3. When so positioned, the container 1 thus has a generally rectangular box-like form with an open top, and may include a desired number of interior dividers 8 positioned to form a desired number of interior compartments of desired sizes. The container 1 includes a hangar portion or hook 11 that rests upon the bed rail R, preferably with the container compartments disposed inside of and along the bed rail for a patient, or resident, to access.

In the foreground of FIG. 1, the container 1 has its outer wall 5 shown, there in a rectangular shape with the longitudinal direction generally parallel to the length of the bed rail R. The outer wall 5 has two ends that connect to the end walls 6. The end walls 6 are shown extending generally perpendicular to the bed rail R and the outer wall 5. The end walls 6 and the dividers 8 form a plurality of compartments 12, generally extending upright. Within the compartments, a patient or resident may place his or her things when occupying the bed. In such view, the dividers 8 are shown joined to the container using parallel but reversed flaps 9 upon the inside and the outside edges of each divider 8.

Looking down the length of a bed rail in FIG. 2, the container 1 again has its rectangular box-like form with the outer wall 5 to the left and an end wall 6 in the foreground. The end wall also has a generally rectangular shape and a height that generally sets the height of the completed container, including the maximum heights of the dividers 8 and the hook 11. The hook 11 has a shank 3, as discussed hereinabove, that extends over the top surface of the bed rail R and a bight 4 that wraps downward around the bed rail R.

Preferably, bight 4 is sized and foldable to be able to snugly wrap around the bed rail R, as shown in FIG. 6, and to be secured to the outer surface of the lower portion 2*a* of inner wall 2 to maintain the container in a stable mounted position upon the bed rail. For bed rails of the type depicted, having no interfering side slats along the extent of the container, bight 4 may be folded inwardly at fold line 4*b*, as illustrated by arrow A, and downwardly at fold line 4*c* so that bight portion 13 will abut the underside of bed rail R and so that bight portion 14 will abut the outer surface of inner wall, to which it may be secured by adhesive or in any other suitable manner.

In the event that the bed includes side slats below the underside of the bed rail R that interfere with positioning bight portion 14 directly against the outer surface of inner wall 2, bight portion 14 could be secured to such slats or, alternatively, fastener elements of any suitable types could be utilized to maintain the positioning of bight portion 14 relative to inner wall 2.

Although it is desirable that bight 4 be able to wrap around bed rail R, such wrapping is not necessarily required if the upper portion 2*b* of inner wall 2 is sized sufficiently to form a suitable hangar portion 11 and the material utilized for the container construction, including the hangar portion 11 has sufficient body to generally maintain the shape of the hangar portion upon bed rail R and to maintain the container in a hanging position upon the bed rail, without serious deformation, especially when a user deposits items in the compartments of the container.

From the foregoing, it should thus be appreciated that that the resultant container of the present invention will, according to one preferred embodiment, often be of rectangular box-like shape and have a hangar portion or hook 11 for attaching to the bed rail R, and may also preferably include a plurality of compartments 12 formed within the outer wall 2, end walls 6, and inner wall 5 by dividers 8, such as are shown in FIG. 1. The compartments 12 are formed from an end wall 6 and a nearby divider 8 or between two nearby dividers 8. The dividers 8 and end walls 6 of the FIG. 1 embodiment have the same height as the lower portion 2*a* of inner wall 2, leading to a flush open top, pleasing in appearance and operative in function to the patient visitors, and hospital staff. Each divider 8 has two parallel flaps 9 at opposite longitudinal ends that adjoin the outer wall and inner wall respectively. The flaps 9 are reversed with one flap folded in the direction towards the left end wall and the other flap folded in the direction towards the right end wall. As will be further discussed hereinafter, with certain embodiments such folding of the flaps is desirable in that it allows for the partial formation and storage of a container body in a partially folded, flattened configuration and for the subsequent easy expansion of the flattened construction to form the completed, expanded container.

FIG. 7 illustrates how a container according to the present invention can be readily formed from two sheets of double-sided corrugated cardboard, with the container base body portion being a unitary body construction foldably formed from a single sheet of double-sided corrugated cardboard, with any desired dividers and stiffener boxes being formed from a second sheet of double-sided corrugated cardboard. The lower sheet of material in FIG. 7 has laid out thereon sheet layout portions that correspond to the inner wall 2, the bottom 7 and end walls 6, and the outer wall 5. The flap portions 2*f* and 5*f* shown with single line shading to the outsides of inner wall portion 2 and outer wall portion 5 may, but need not necessarily, be removed prior to folding of the sheet. Similarly, the flap portions 3*f* and 4*f* shown with cross-hatch shading to the outsides of shank portion 3 (including bight portion 4) may also, but need not necessarily be removed prior to folding of the sheet. Layout partition lines in the form of solid lines indicate where the sheet may be pre-scored or where portions should be separated from one another prior to folding. Layout partition lines in the form of dotted lines indicate fold lines, which may be pre-marked and/or formed on the cardboard sheet.

As is indicated by arrows B and C, once the separations are verified, the end wall portions 6 are folded upwardly along fold lines 6*a*, and the edge flaps 6*f* therealong, the lower sides of which may be pre-coated with an adhesive, are folded inwardly towards one another, as illustrated by arrows D and E. Outer wall portion 5 is folded upwardly along fold line 5*a* and the flaps 6*f* of end walls 6 nearest outer wall 5 are secured to outer wall 5. If the flaps 5*f* to the outside of outer wall 5 were not removed, such flaps, the upper sides of which may be pre-coated with an adhesive, can be folded along fold lines 5*b* to dispose such flaps adjacent to the outer surfaces of end walls 6, to which they can be secured. Inner wall 2 is folded upwardly along fold line 2*c* and the flaps 6*f* of end walls 6 nearest inner wall 2 are secured to inner wall 2. If the flaps 2*f* to the outside the lower portion of inner wall 2 were not removed, such flaps, the upper sides of which may be pre-coated with an adhesive, can be folded along fold lines 2*d* to dispose such flaps adjacent to the outer surfaces of end walls 6 and/or the flaps 5*f*, to which they can be secured. After such folds, the resulting body construction configuration is similar to the formed container body portion shown in FIG. 5, with formed inner wall, outer wall, end wall, and bottom portions, although without any dividers 8.

The shank portion 3 of inner wall 2 is then folded outwardly along fold line 3*a* and bight portion 4 is then folded downwardly along fold line 4*a* to form the hangar portion or hook 11 as best shown in FIGS. 1-3 and 6. As has been discussed hereinabove, when the formed container body portion is positioned on bed rail R, the bight 4 may be further folded to wrap around bed rail R and secured to the outer surface of the lower portion 2*a* of inner wall 2, if desired or considered necessary or advisable.

At an appropriate stage in the assembly of the container, typically after folding of the cardboard sheet to form the container base body portion and the further configuration thereof to form a formed container body portion having the general shape of an upright open-topped box resting upon its closed bottom, the divider portions 8 can be removed from the second sheet of double-sided corrugated cardboard and can be folded appropriately and installed extending between the inner and outer walls 2 and 5 of the formed container body portion to form a desired number of compartments in the assembled container. Appropriate sides of the flaps 9 of the dividers 8 may be pre-coated with an adhesive to facilitate joinder of the dividers 8 to the inner and outer walls 2 and 5.

The second sheet of cardboard may also have laid out thereon a plurality of stiffener box portions 10 which can be separated from one another and folded along fold lines to form stiffener boxes similar to what is shown in FIG. 5, which stiffener boxes can be inserted into the compartments formed within the container by the end walls 6 and the dividers 8 to strengthen the container. The flap portions 10*f* shown with single line shading at one end of the foldable element 10 may, but need not necessarily, be removed from the separated elements 10. If such flap portions, which may be pre-coated with adhesive on an appropriate side thereof, are not removed, they may be folded to overlap an outside surface of the foldably assembled stiffener box and to be secured thereto to better maintain the assembled stiffener box in its assembled state.

As will be appreciated by those skilled in the art, the order of folds and other assembly steps set forth hereinabove is exemplary only, and different orders can be employed to achieve essentially the same result.

FIG. 8 illustrates a different layout on a single sheet of double-sided corrugated cardboard from which it is possible to form a partially assembled, flattened container construction, similar to what is depicted in FIG. 9, that users can quickly and easily expand to form a completed, expanded container that can be installed upon a bed rail or like rail. The cardboard sheet of FIG. 8 has laid out thereon various container portion layouts, with solid lines indicating where the sheet may be pre-scored or where portions should be separated from one another prior to folding and with dotted lines indicating fold lines, which may be pre-marked and/or formed on the cardboard sheet. The small flap areas that have single line shading may, but need not necessarily, be removed.

Initially, the separable portions are separated from one another along the indicated separation lines. Significantly, inner wall 2 is separated from outer wall 5 along separation line 5*c*. End walls 6 are folded downwardly along fold lines 6*a* and flaps 6*f* of end walls 6, the upper surfaces of which may be pre-coated with an adhesive, are folded towards one another along fold lines 6*b*. Such flaps 6*f* are positioned along the outer ends of the lower portion 2*a* of the separated inner wall 2 portion layout and secured thereto. The flaps 9 of the separated dividers 8, appropriate sides of which flaps may be pre-coated with an adhesive, may then be folded in reverse directions and the dividers may be installed extending between the inner and outer walls 2 and 5 at desired locations. The resultant partial assembly may be flattened to effect a flattened construction similar to that shown in FIG. 9, in which, for illustrative purposes, the bottom 7 is shown bent upwardly and back instead of in a flattened condition essentially co-planar with outer wall 5.

When the container is in such partially assembled, flattened, configuration, the outer wall 5 has a generally rectangular shape connected at its ends to the end walls 6, the uppermost of which end walls is seen at the left side in FIG. 9. The outer wall 5 has top and bottom edges, with the bottom edge connected to bottom 7 at fold line 5*d*, as may be better seen in FIG. 8. The bottom 7 generally has the same length as the inner wall 2, and includes a base bottom portion 7*a* of a width generally the same as the length of the central (non-flap) portion of end walls 6 and, preferably, a flap portion 7*b* between a fold line 7*c* and the outer edge of bottom 7, which flap portion 7*b* will be further addressed hereinafter. The end walls 6 connect to the inner wall 2 opposite their connections to the outer wall. In FIG. 9, the inner wall 2 is shown disposed slightly below the outer wall 5. The inner wall 2 generally is parallel to the outer wall 5 but has a greater height as it extends above and away from the top of the end walls 6. The inner wall 2 has an upper wall portion 2*b* that includes a shank portion 3 exterior to a fold line 3*a*, with a bight 4 exterior to a fold line 4*a*, and with the shank and its bight portion forming a hangar portion or hook 11 when folded.

The cardboard sheet of FIG. 8 also includes thereon two shelf constructions 14, with side flaps 4*f*, which shelf construction, somewhat similarly to the stiffener box 10, can be folded and inserted into a compartment of the container to further strengthen the container. Such a shelf construction, when inserted within a compartment, also serves to make that compartment shallower.

With reference to FIG. 9, the partially assembled, flattened construction depicted therein may be readily expanded by a user by lifting the outer wall 5 away from the inner wall 2, as is indicated by arrows F. During such lifting operation, the dividers 8 and end walls 6 unfold, generally in parallel, away from the bottom 7. When the end walls 6 are substantially transverse or perpendicular to the inner and outer walls 2 and 5, bottom 7 is folded downwardly along line 5*d*, as indicated by arrows G, and flap portion 7*b*, the bottomside of which may be pre-coated with an adhesive, is folded upwardly to abut the outside surface of inner wall 2 and is secured thereto. The upper portion 2*b* may then be folded in similar manners to those that have been previously discussed relative to other embodiments and the container construction may be installed on a bed rail or like rail, and the shelf constructions may be folded and installed, as desired, in appropriate compartments of the container.

Figure 10:
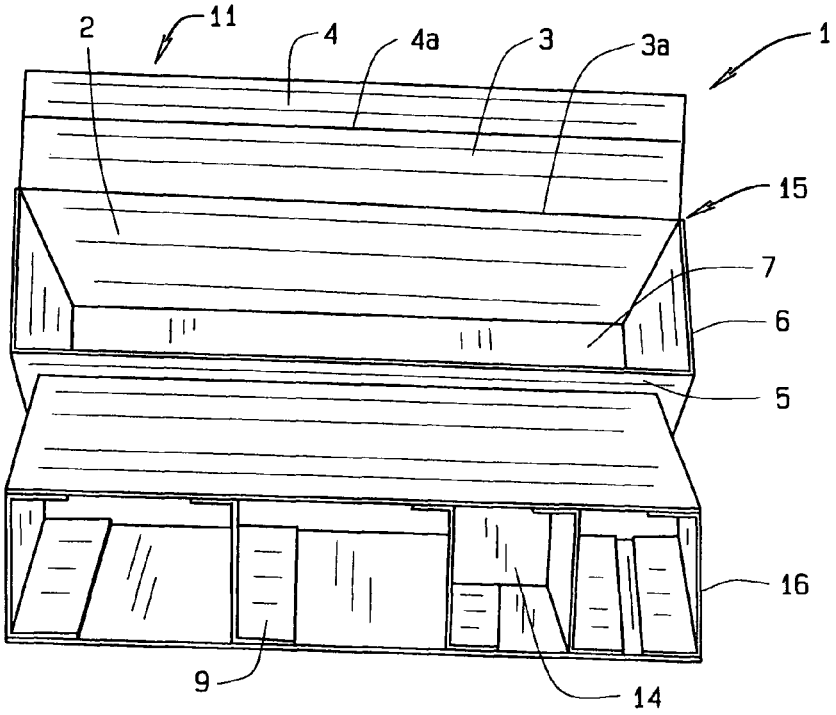
FIG. 10 is a view of an alternate embodiment of the invention where dividers are included within an insert that is then placed into a container base body portion.

Another alternate embodiment of the present invention is shown in FIG. 10. The container 1 there depicted includes an outside container portion 15 similar to the foldably expandable base container portion realizable by folding the lower sheet of FIG. 7, as described hereinabove. Such outer container portion 15 includes an inner wall 2 with an upper portion that includes a shank 3 and a bight 4 that are foldable to form a hangar portion or hook 11 for placement of the outer container portion 15 upon a bed rail R. Opposite and parallel to the inner wall 2, the outer container portion 15 has an outer wall 5. Spaced apart and mutually parallel, two end walls 6 connect to the inner and outer walls 2 and 5 at the outer ends of the outer container portion 15. A bottom 7 connects to the inner wall 2, the outer wall 5, and the end walls 6, and defines the lower boundary of the outer container portion 15. Such outer container portion 15 is generally hollow and of a rectangular box-like shape.

To provide compartments 12 within the completed container, a container insert 16 is formed and placed within the outer container portion. The insert 16 is a lattice construction similar to container constructions such as have been described and discussed hereinabove, although not including the upper portion 2*b* of the inner wall 2 or the bottom 7, and, like the partially assembled, flattened construction depicted in FIG. 9, can, if desired, be stored in a flattened condition.

In FIG. 10, the insert 16, which is there shown outside of the outer container portion 15, has, when in its expanded form, a generally rectangular box-like shape of similar, but slightly lesser, dimensions than those of the outer container portion 15 so that the insert can fit snugly within the outer container portion 15. Like the outer container portion 15, the insert 16 has two mutually parallel and spaced apart inner and outer walls which are connected to one another by two mutually parallel and spaced apart end walls and by a plurality of dividers 8 that have flaps 9. The flaps 9 secure to the interior of the inner and outer walls. In FIG. 10, three dividers are shown located between the end walls to divide the interior of the insert into four separate cubbyholes or compartments, although greater or fewer dividers could be utilized depending upon the desires of the user. An optional shelf construction 14 is shown located between two dividers 8 within one of the formed cubbyholes. If desired, additional shelf constructions as well as stiffener boxes could also be utilized.

To complete the assembly of the container embodiment presented in FIG. 10, the expanded and formed insert 16 is placed within the outer container portion 15 and the completed container construction is mounted at a desired location along the bed rail.

From the foregoing, in which various embodiments of the present invention have been presented in the process of assembly, or assembled, it should be appreciated that the container of the present invention may be made from one or more sheets of double-sided corrugated cardboard. Preferably, the wall elements of the base container portion are laid out on a single sheet of material, as in FIGS. 7 and 8, although it will be appreciated from FIG. 8 that, with some embodiments, such wall elements could be formed from two or more separate sheets if desired. For some embodiments, divider elements, stiffener elements, and shelf elements may be laid out on additional material sheets for convenience of manufacture, shipping, and storage.

It has been found convenient to join various of the elements to one another by means of adhesive, or glue, as noted in the foregoing discussions, and/or by the application thereof at room temperature or heated during formation of the container. The adhesive may also be conveniently applied in strips with dots of adhesive as an alternate method of application. Although the use of adhesive is recognized as being convenient, any other manners of joinder that achieve the intended purpose of securing the appropriate elements in place relative to one another may also be utilized.

Figure 11:
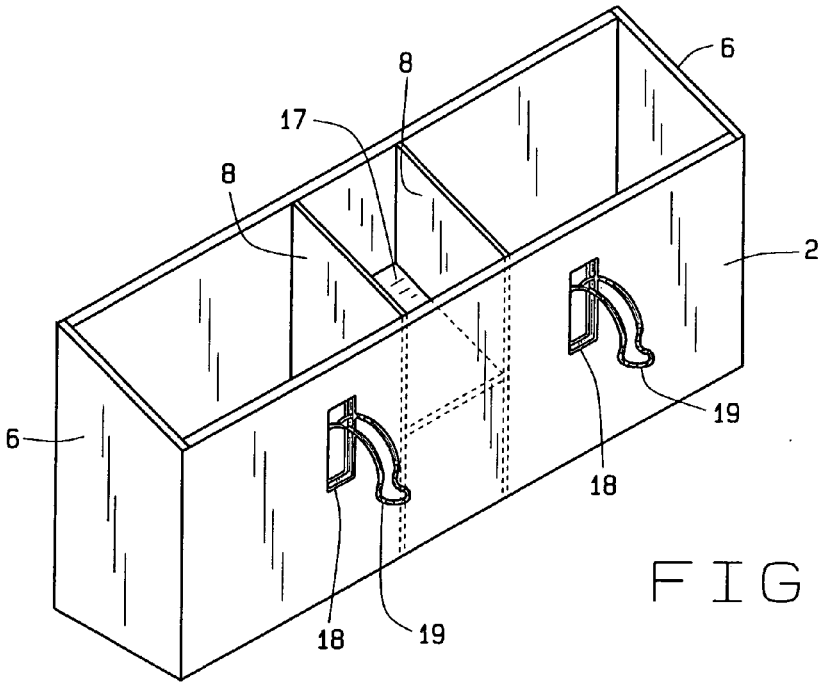
FIG. 11 is a perspective view of a container with hinged hooks and an internal shelf.
Figure 12:
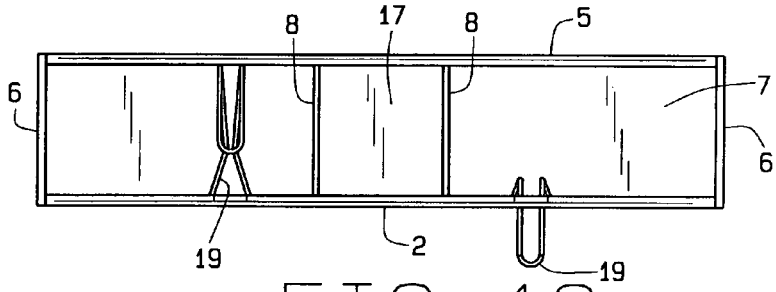
FIG. 12 is a top view of the container of FIG. 11 showing one hook rotated inward and the other hook rotated outward; and, FIG. 13 is a front view of the container of FIG. 11 showing apertures in the inner wall for hooks, but with no hooks installed.
Figure 13:
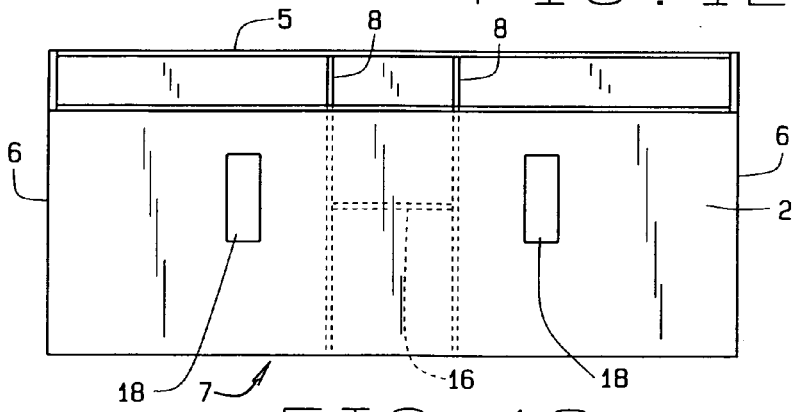

FIGS. 11-13 depict a further embodiment of a container according to the present invention, but in which the hook for hanging the completed container on the bed rail takes a different form. Such embodiment has an inner wall 2 extending longitudinally and an opposite outer wall 5 generally parallel and spaced apart from the inner wall 2. The outer wall 5 has a greater height than the inner wall 2 that improves display of items within the container. The inner wall 2 and the outer wall 5 extend upwardly from the edges of the rectangular bottom 7. Generally perpendicular to the inner wall 2, the container has a pair of mutually parallel and spaced apart end walls 6. Each end wall 6 spans from the outer wall 5 to the inner wall 2 at an end of the bottom 7 and has a generally trapezoidal shape with the longer side adjoining the outer wall 5.

Within the interior of the container and parallel to the end walls 6, a plurality of dividers 8 are employed to subdivide the space within such interior. In the depicted embodiment, the dividers 8, like the end walls 6, also have a generally trapezoidal shape with the longer sides adjoining the outer wall 5, generally in the same orientation as the end walls 6. In a further refinement, the dividers 8 may have a concave lower edge (not shown) proximate the bottom.

Between two dividers 8, and generally centered in the depicted embodiment, the container has a shelf 17 generally parallel to and spaced above the bottom. The shelf is generally perpendicular to the inner wall 2 and spans from the inner wall 2 to the outer wall 5.

In the depicted embodiment, the inner wall 2 of the container includes one or more apertures 18 sized to admit a hook 19 therethrough that is operable to engage a bed rail R. In such embodiment, the hook has a generally open linear form, preferably a wire bent double, curved into a classic hook shape with a bight for engaging the bed rail and with an opposite shank secured to the inner wall. As best seen from FIG. 12, each hook is rotatable from a stowed position within the container to an extended position outside the inner wall 2 for reaching and engaging the bed rail. Alternatively, each hook may be made from sections of inner wall made rigid by an adhesive or a reinforced corner of paperboard or cardstock.

In FIG. 12 it can be readily observed that the outer wall 5 of such embodiment is generally parallel to the inner wall 2, with the end walls 6 at the opposed ends of the bottom 7. The dividers 8, shown as a pair, extend from the outer wall 5 to the inner wall 2 while being generally parallel to the end walls 6. Between the dividers 8, the shelf 17 spans from one divider to the next, generally parallel to the bottom. Outwardly sidewardly from the shelf 17 and the dividers 8, the container has two additional compartments for storing items and stowing the hooks 19 during transport of the container.

In such FIG. 12, the compartment on the left shows a hook 19 stowed within that compartment while the compartment on the right shows a hook 19 rotated outward of the inner wall 2 and ready to reach and engage a bed rail. The hook 19 on the left has an open linear form there shown as a wire bent double, with a closed end bent round that forms the tip of the hook. The wire extends and curves away from the tip into the bight of the hook. When the curve of the bight returns to the shank, the wire straightens both ends that approach each other. Generally opposite the tip of the hook, the ends of the wire extend mutually oppositely but co-linearly. The ends of the wire fit within the inner wall and operate as a hinge to allow rotation of the hook from within the container, as in the left compartment, to outward of the inner wall 2, as shown relative to the right compartment.

Although the shelf 17 may typically be a shelf of the type such as was described relative to other container embodiments discussed hereinabove, it may also be formed in other manners, such as from a folded extension of the dividers 8, or from other materials. In one preferred form, the shelf links both dividers 8 together and each divider 8 may have at least one tab on each edge that slides within the double wall construction of the outer wall 5 and inner wall 2, respectively.

The position of the shelf 17 is best seen in FIG. 13, which is a front view of the container with the hooks removed for clarity, wherein the shelf 17 is shown in phantom. The outer wall 5 of the container is seen in the background and the inner wall 2 is seen in the foreground and being of generally lower height than the outer wall. The two dividers 8 span from the outer wall 5 to the inner wall 2 and extend downwardly from the tops of the inner and outer walls 2 and 5 to the bottom 7 to generally define a centered compartment. The dividers support the shelf 17, shown in phantom, that spans from the inner wall 2 to the outer wall 5 generally parallel to and spaced above the bottom 7. The inner wall 2 has two apertures 18, each of which is generally centered in the compartment outwardly of the center compartment with its shelf 17. The apertures 18 are generally elongated vertically and allow for rotation of the hooks 19 therethrough.

In FIGS. 11-13, the embodiment depicted therein is shown as an assembled construction, which assembled construction can be formed from a single sheet of material. In general, the elements of the container may be advantageously laid out on the material sheet in such a way that the sheet is folded along fold lines or scores on the sheet to result in an assembled construction in which the inner wall 2, the outer wall, 5 the end walls 6, the dividers 8, and the shelf 17 are essentially of double-walled strength and the container bottom 7 includes a number of interleaved portions, including extensions of the inner wall, the outer wall, and the end walls, for additional strength. Such interleaving strengthens the bottom as more items and weight are placed inside the compartments to rest upon the bottom of the assembled container. In such construction, the outer wall, inner wall, dividers, end walls, and shelf are joined by tabs positioned into slots, such as slots formed between double wall folds, and the hook is manufactured from bent steel wire with the bight and shank of the hook having a coating to resist abrasion. Such embodiment has minimal usage of adhesive.

Figure 14:
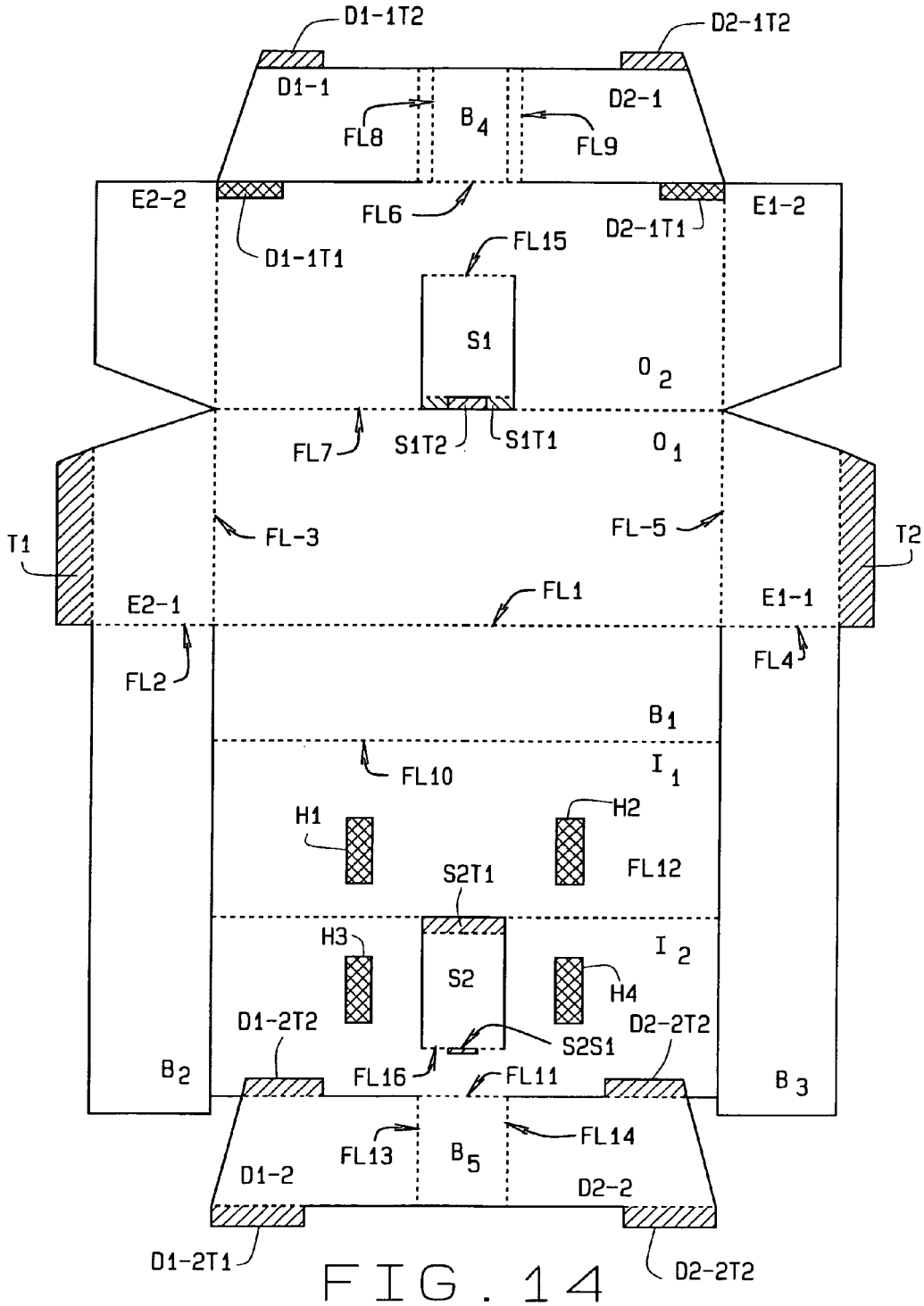
FIG. 14 is a plan view of view of a single sheet of cardboard showing a possible layout for a container such as is depicted in FIGS. 11-13.

FIG. 14 shows one preferred material sheet layout that can be utilized to form an assembled container similar to that depicted in FIGS. 11-13. In such layout, solid lines represent separation lines between sheet portions, dotted lines represent fold lines, and portions shown in single line shading identify tab portions. The portions that form the formed inner wall when the material sheet is folded are identified by the legends T1 and T2; the portions that form the formed outer wall when the material sheet is folded are identified as O1 and O2; the portions that form the respective formed end walls when the material sheet is folded are identified as E1-1, E1-2 and E1-2, E2-2; the portions that form the formed container bottom when the material sheet is folded are identified as B1, B2, B3, B4, and B5; the portions that form the respective dividers are identified as D1-1, D1-2 and D2-1, D2-2; and the portions that form the shelf are identified as S1 and S2.

In accordance with one folding technique for forming the assembled container, a user starts by ensuring that the various breaks at the solid lines are complete and preferably bends the tab portions along their fold lines to facilitate subsequent assembly. With the material sheet in a horizontal position as depicted in FIG. 14, portion O1 (with the attached portions shown to the top of O1) is folded up along fold line FL1 to approximately a vertical position.

The user then folds portion B4 (and connected portions D1-1 and D2-1) outward (backward) along fold line FL6 to abut the backside of portion O2, folds portion O2 (and the attached folded back portions B4, D1-1 and D2-1) inward (forward) along fold line FL7 to abut the frontside of portion O1. Next, portion B2 is folded up along fold line FL2 to abut portion E2-1, portion E2-1 is folded in along fold line FL3, and portion B2 is folded down along fold line FL2 to overlay portion B1. Then, portion B3 is folded up along fold line FL4 to abut portion E1-1, portion E1-1 is folded in along fold line FL5, and portion B3 is folded down along fold line FL2 to overlay portions B1 and B2. The user then folds portion B4 (and connected portions D1-1 and D2-1) forward (downward) along fold line FL6 to overlay portions B1, B2, and B3.

Next, the user folds portion I1 (with the attached portions shown to the bottom of I1 in FIG. 14) up along fold line FL10 to approximately a vertical position. The user then folds portion B5 (and connected portions D1-2 and D2-2) outward (forward) along fold line FL11 to abut the frontside of uprightly positioned portion 12, folds portion 12 (and the attached folded back portions B5, D1-2 and D2-2) inward (backward) along fold line FL12 to abut the backside of portion 11, and then folds portion B5 (and connected portions D1-2 and D2-2) inward (downward) along fold line FL11 to overlay portions B1, B2, B3, and B4.

At this stage in the folding operation, the basic rectangular, box-like shape of the container has been established, and, if no dividers are shelf are desired, the tabs T1 and T2 may be inserted into the slots formed between inner wall portions I1 and I2 to complete the assembled container. If desired, strategically located adhesive and/or tape may be utilized to even better maintain the shape and structure of the assembled container.

Figure 15A:
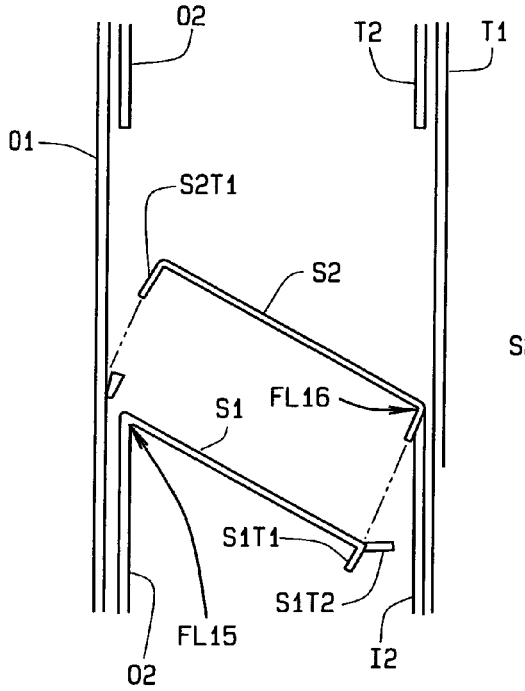
FIGS. 15*a* and 15*b* are enlarged views of a portion of the single sheet of cardboard of FIG. 14 during the process of assembly of the container by folding of such cardboard sheet, showing tabs associated with the shelf being employed in such assembly.
Figure 15B:
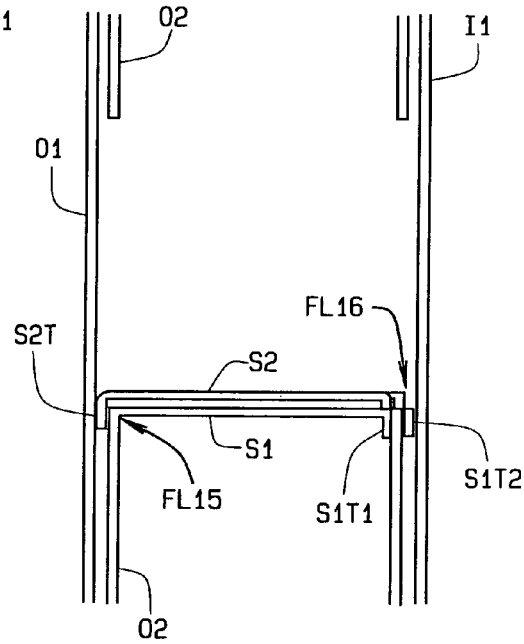

To complete the assembly to include dividers and a shelf, the user may fold portions S1 and S2 upwardly along respective fold lines FL15 and FL16 and then insert tab portion S1T2 into hole slot S2S1 and tab portion S2T1 into the slot formed between outer wall portions O1 and O2, as shown in FIGS. 15*a* and 15*b*, to form the shelf. If dividers, but no shelf, are desired, the user may forego this step and proceed to form one or more dividers.

Figure 16:
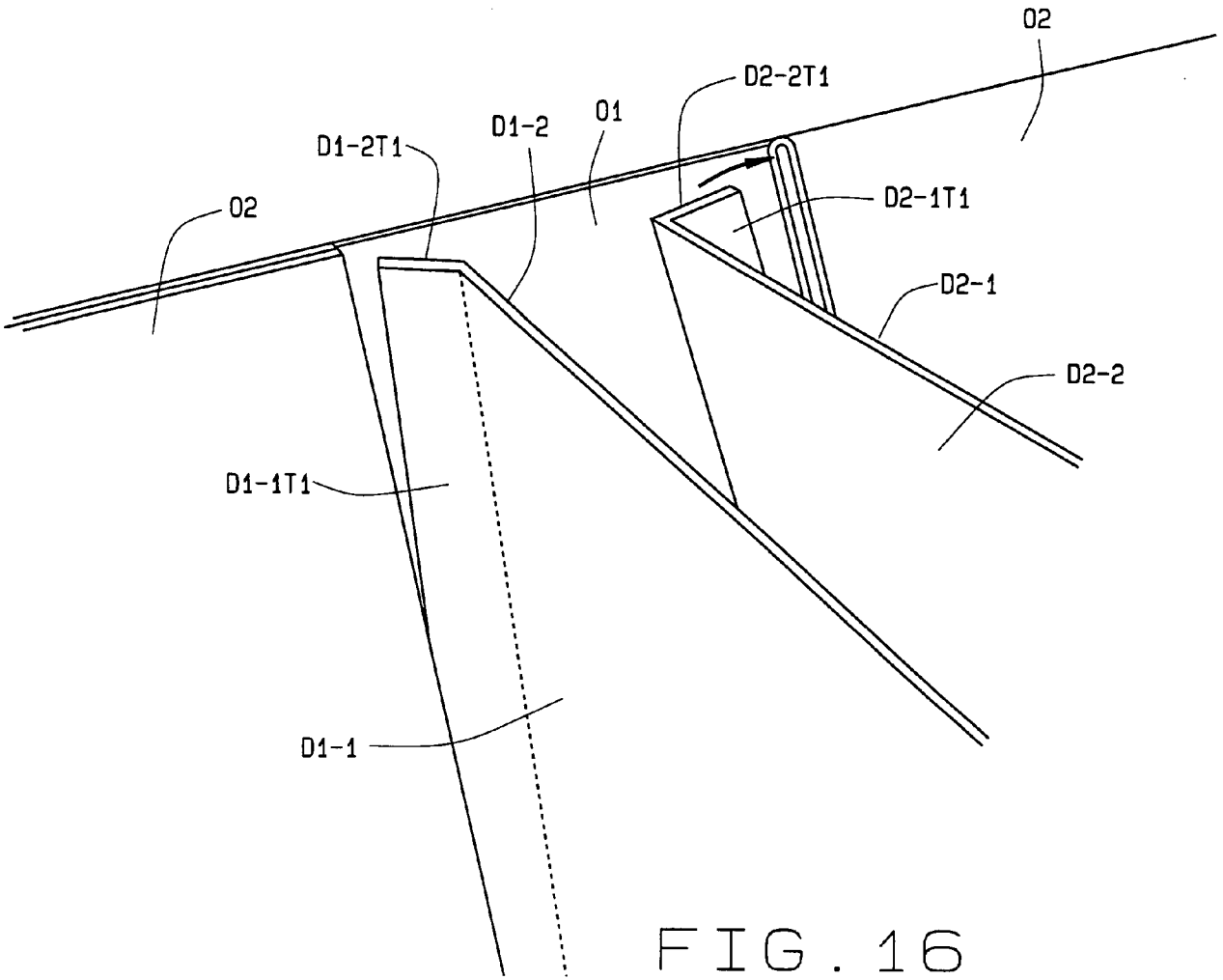
FIG. 16 is a greatly enlarged view of a portion of the single sheet of cardboard of FIG. 14 during the process of assembly of the container by folding of such cardboard sheet, showing tabs associated with the dividers being employed in such assembly.

To form dividers, the user may fold divider portion D1-2 and underlying divider portion D1-1 upwardly along their respective fold lines FL13 and FL8 and divider portion D2-2 and underlying divider portion D2-1 upwardly along their respective fold lines FL14 and FL9, and insert the coupled, respective tab portions D1-1T1, D1-2T1 and D2-1T1, D2-2T1 into the slots formed between the outer wall portions O1 and O2, as shown in FIG. 16.

When the container has been thus foldably assembled, hooks 19 may be installed with ends thereof disposed in slots formed between the inner wall portions I1 and I2 so as to be rotatable through the aligned cutout pairs H1, H3 and H2, H4 in such inner wall portions, and the completed assembly may then be mounted at a desired location upon bed rail R.

Figure 17A:
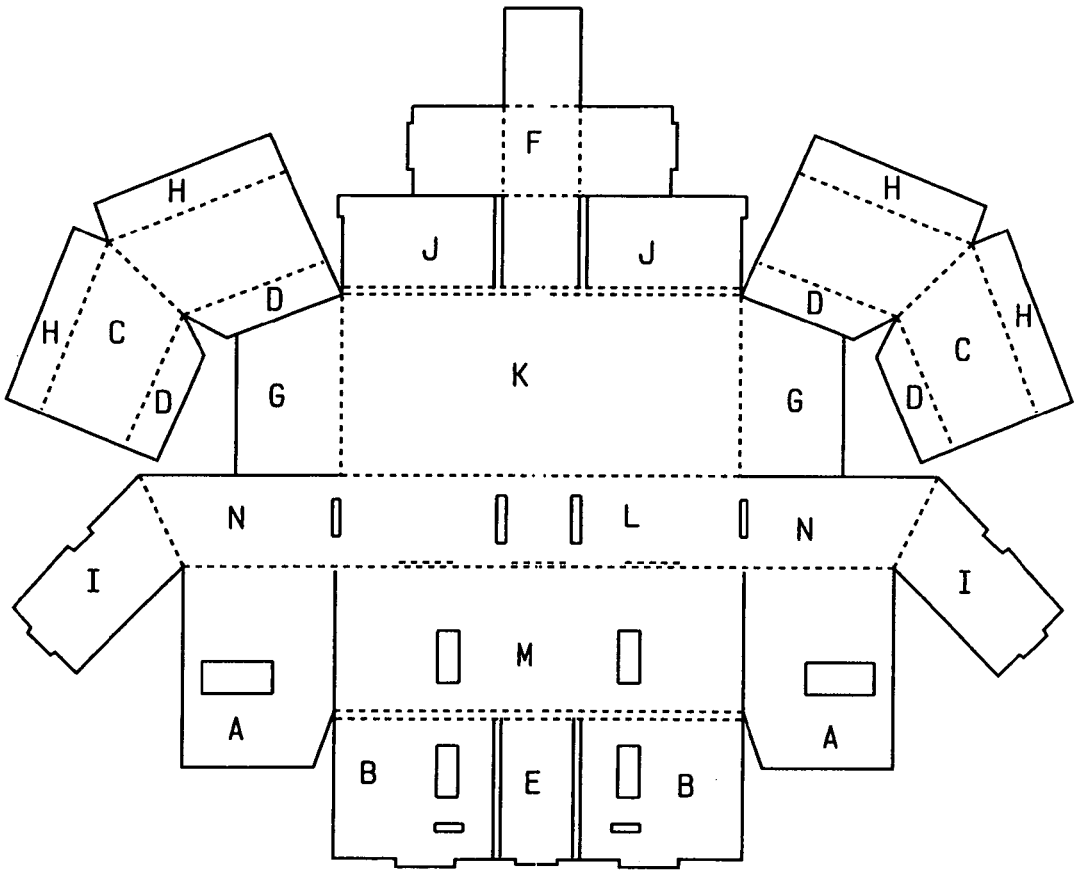
FIGS. 17*a*-17*d* depict another embodiment of a sheet of material and the layouts thereon, and illustrate how the sheet may be folded to effect a container construction similar to that shown in FIG. 11.

FIG. 17*a* depicts another sheet of material, with layout portions thereon, which can be folded to form an assembled tray, to which metal hook hangars can then be added to effect a container construction similar to the construction of FIG. 11. The material sheet may be folded, as shown in FIGS. 17*b*-17*d* to effect such assembled tray.

Figure 17B:
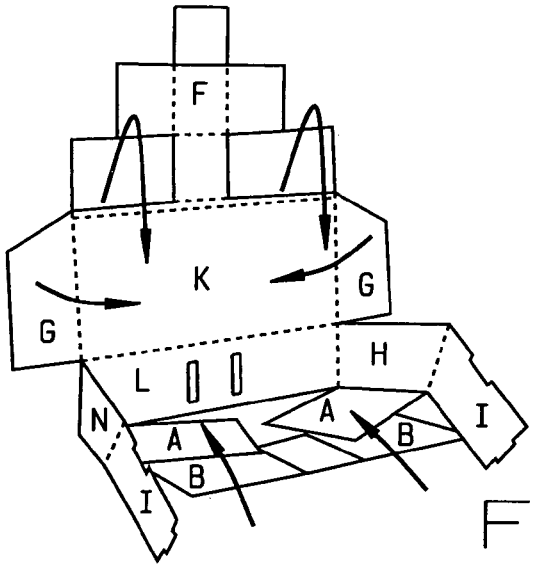
Figure 17C:
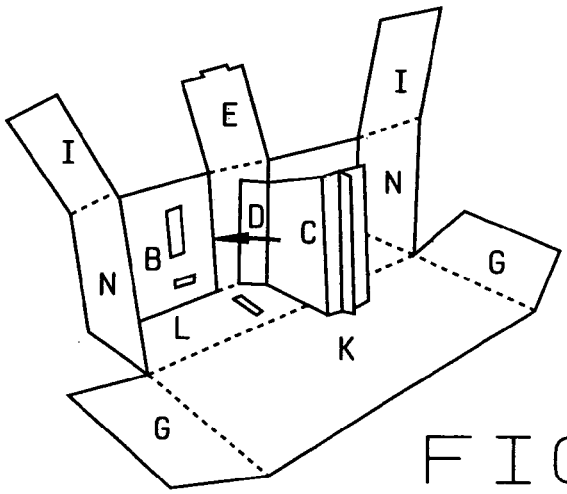
Figure 17D:
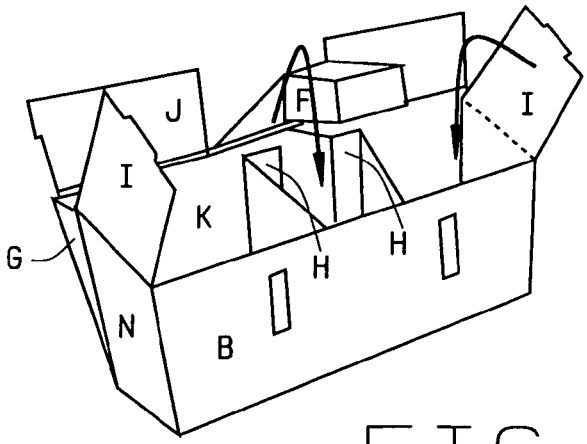

To foldably assemble the tray from the material sheet of FIG. 17*a*, a user would 1. lay the sheet of material on a clean, flat surface, such as a table, as shown in FIG. 17*a*, and pre-fold all scores, separating dividers C (with their flap wings D and H) from the other elements on the material sheet;
2. fold flaps A (and attached portions N and I), as shown in FIG. 17*b*, so that flaps A overlap opposite end portions of M, with flaps I extending generally forwardly and downwardly over the edge of the table;
3. roll flaps B over respective flaps A and lock them at the bottom of the tray, as shown in FIG. 17*b*, with flaps I still extending outwardly;
4. fold F and J back behind K and re-position the partially folded construction on the table with K forward, as shown in FIG. 17*c*, and with F and J underneath K;
5. fold separated dividers C in half and fold out wings D and H of each divider in opposite directions;
6. position dividers C as shown in FIG. 17*c*, and slide wing D of each behind a respective flap B;
7 after completion of such installation of both dividers, fold the ends of the dividers C near K away from one another and fold flap E, as shown in FIG. 17*c*, forward and down between dividers C to abut M;
8. fold flaps G to overlay opposite end portions of K and fold K upwardly;
9. re-orient the tray so that B is forward and K is back, as shown in FIG. 17*d*, and, with dividers C near K still folded away from one another, fold F forward into the tray to form a platform between dividers C;
10. unfold flaps G to abut the inner sides of respective portions N, as shown in FIG. 17*d*, making sure that they are to the inside of the tray;
12. square up dividers C by pushing flaps H between K and the portion of platform F abutting K;
13. fold flaps I inwardly and down into the tray over flaps G and lock them at the bottom of the tray, forming the tray sides as shown in FIG. 17*d;*
14. fold flaps J forward and down into the tray to abut K, and lock the tabs on the outer edges in place to complete the tray.

Once the tray, has been so assembled, the hooks may then be installed and the completed container construction can be hung upon the bed rail.

Figure 18A:
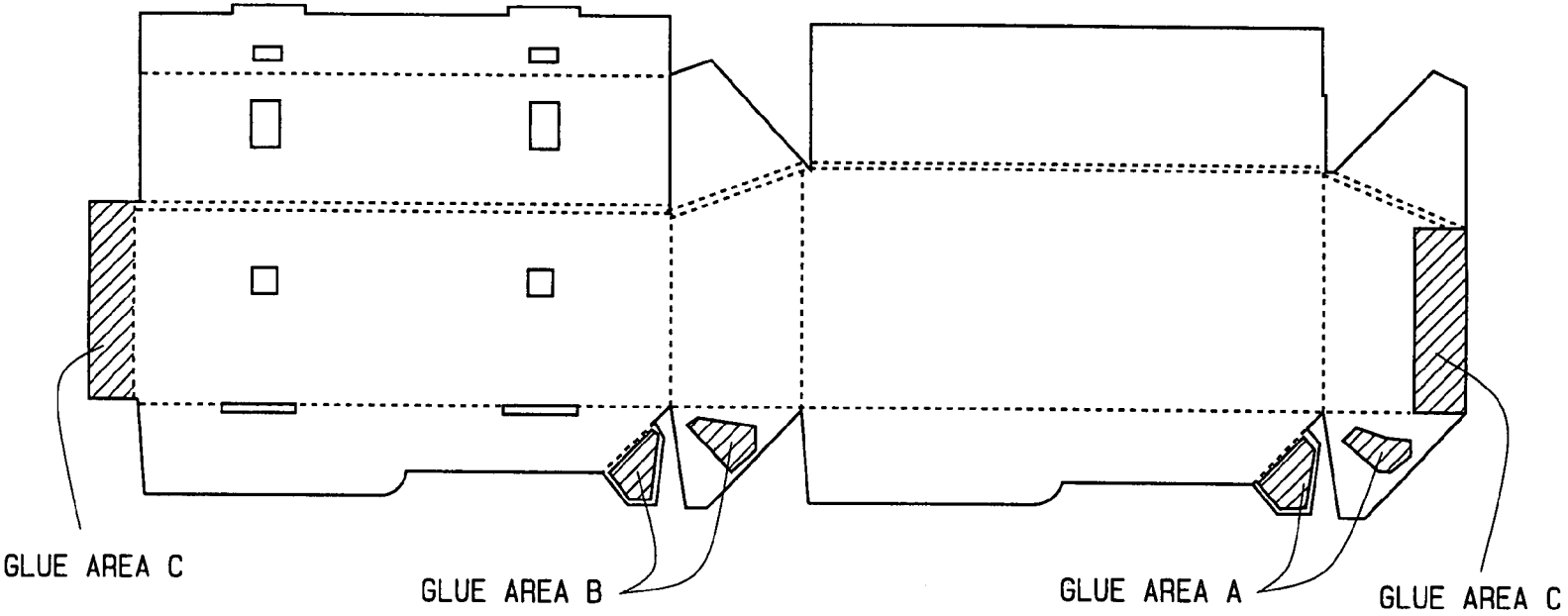
FIGS. 18*a*-18*d* depict still another embodiment of a sheet of material and layouts thereon, and illustrate how the sheet may be folded to effect a container construction similar to that shown in FIG. 11.

FIG. 18*a* depicts still another sheet of material, with layout portions thereon, which can be folded to form an assembled tray, to which metal hook hangars can then be added to effect a container construction similar to the construction of FIG. 11. The material sheet may be folded, as shown in FIGS. 18*b*-18*d* to effect such assembled tray.

Figure 18B:
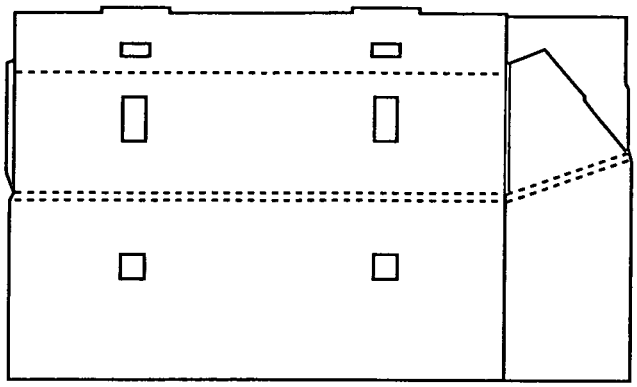
Figure 18C:
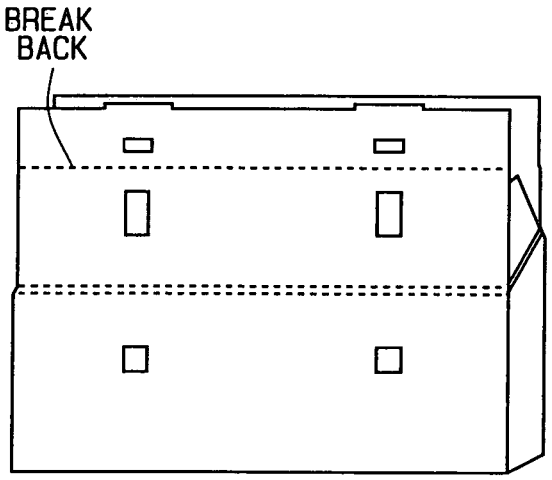
Figure 18D:
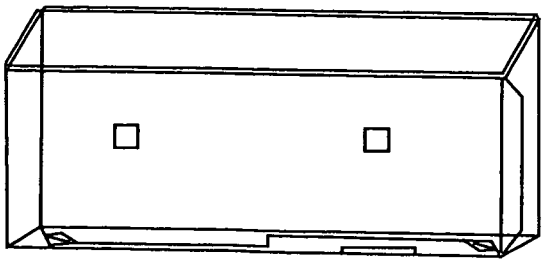

To foldably assemble the tray from the sheet of material of FIG. 18*a*, a user would 1. fold the sheet to roughly form a box, joining respective glue area pairs A, B, and C, as shown in FIG. 18*a*, together.
2. square the tray by pushing both ends toward the center, as shown in FIG. 18*b*, causing the bottom of the tray to automatically lock into position;
3. fold the top flaps in the following order;
   a. first, as shown by arrow 1 in FIG. 18*c*, fold the large flap without holes;
   b. second, as shown by arrow 2 in FIG. 18*c*, fold the two small side flaps until they lock into the first flap;
4. take the flap with the holes and tuck the whole panel into the tray until the tabs lock into the slots, recognizing that it will be necessary to break the back score to accomplish that, as shown in FIG. 18*d*.

Once such tray has been so assembled, the hooks may then be installed and the completed container construction can be hung upon the bed rail.

From all the foregoing, those skilled in the art will also understand and appreciate that the particular layouts shown can be modified or altered in various ways, including by the dimensioning of certain element portions or by the inclusion of additional portions or tabs, in order to provide for additional features that may be considered desirable for an assembled container, such as, but not limited to, a tilting of the articles within the container towards the outside wall so that a patient can more easily reach and remove articles from the assembled and mounted container.

Figure 19:
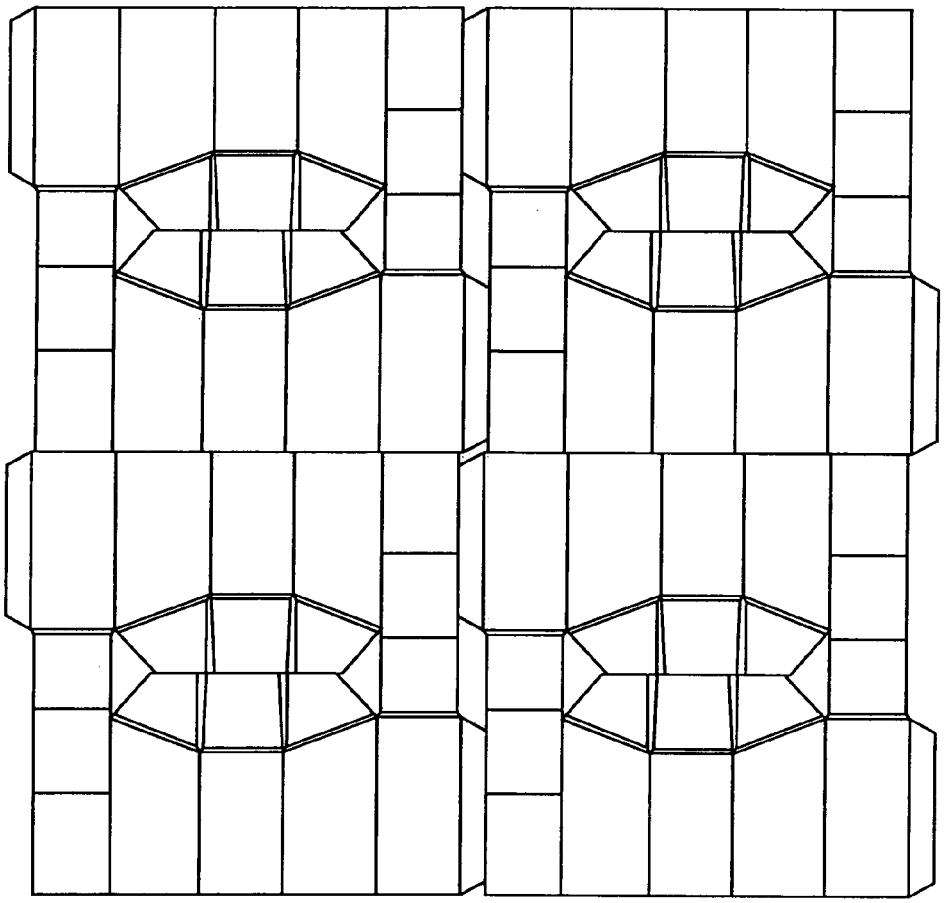
FIG. 19 depicts a single, larger sheet of material on which are layouts in still another form for multiple containers.

Variations or modifications of the subject matter of the present invention and the embodiments thereof may occur to those skilled in the art upon reviewing the disclosure provided herein, including the layouts for multiple containers on a single material sheet, as presented in FIG. 19. From such layout presentation, those skilled in the art can determine various manners of separation and subsequent foldings of the individual layouts to effect containers according to the present invention. Such variations or modifications are intended to be encompassed within the scope of the invention as described herein. The description of the preferred embodiment and of the drawings showing the same are provided herein for illustrative purposes only.

While the several preferred embodiments discussed hereinabove have made use of double-sided corrugated cardboard sheets or cardboard sheet portions folded over to effect double strength elements, both of which options permit the resultant container to be sufficiently sturdy for the intended purpose, other materials may also be employed to form a container according to the present invention, provided such materials can form a container generally able to maintain its shape and to hold and store items therein when the container is mounted to hang on a bed rail or like rail. In such regard, the container and its various components or elements may thus be manufactured from many materials, including, but not limited to, paperboard, cardstock, cardboard, wood, plywood, polymers, high density polyethylene HDPE, polypropylene PP, polyethylene terephalate ethylene PETE, polyvinyl chloride PVC, nylon, ferrous and non-ferrous metals, their alloys and composites.

The various phrases and terms employed herein to describe and discuss the invention are utilized for purposes of description and illustration, and should not be regarded as limiting. As such, those skilled in the art will appreciate that the conception upon which this disclosure is based may readily be utilized as a basis for the designing of other structures, methods and systems for carrying out the several purposes of the present invention. Therefore, the claims are intended to include such equivalent constructions insofar as they do not depart from the spirit and the scope of the present invention.

We claim:

1. A foldably assemblable container for hanging upon a generally horizontally extending bedrail, comprising:

a sheet of material including thereon body portions designated as a container inner wall portion layout, a container bottom portion layout, a pair of container end wall portion layouts, and a container outer wall portion layout, said body portion layouts defining partition lines for said body portions on said sheet of material, said sheet of material and said body portions thereon being manually manipulatable by a user to form from said body portion layouts an assemblable container that comprises a container base body portion having a formed inner wall portion formed from said inner wall portion layout, a formed outer wall portion formed from said outer wall portion layout, a pair of generally similar formed end wall portions formed from said end wall portion layouts, and a formed bottom portion formed from said bottom portion layout, said formed inner and outer wall portions having generally rectangular configurations of substantially similar defined lengths but of differing defined heights, with the lengths being greater than the heights and widths than said formed inner wall portion and having a height greater than the height of said formed outer wall portion and an upper edge extending along said height, said formed end wall portions configured to have defined widths less than the maximum height of said formed end walls, with the height thereof at a first end of said defined width of said formed end wall portions being approximately equal to the height of said formed outer wall portion, and with the height thereof at the opposite end of said defined width of said formed end wall portions being substantially greater than or equal to the height thereof at said first end of said defined width of said formed end wall portions, said formed bottom portion having a generally rectangular configuration with a defined length substantially similar to the defined lengths of said formed inner and outer wall portions and a defined width approximately the same as the defined width of said formed end wall portions, said inner, outer, and end wall portions and said formed bottom portion being generally formed of a singular sheet material construction as formed and being interconnectable to form said container base body portion, with said formed end wall portions extending between and connecting internally of said formed inner and outer wall portions at opposed ends thereof, said container base body portion manually configurable by a user to effect a formed container body portion that assumes and holds the general shape of an upright open topped box resting upon said bottom portion and having an interior compartment, with said formed bottom portion positioned extending generally between said formed inner, outer, and opposed end wall portions to close the bottom of said formed container body portion and to define the container width, said formed end wall portions of said formed container body portion joined to said formed inner and outer wall portions with their maximum heights positioned adjacent to said formed inner wall portion to define a first wall top fold line along the length of said formed inner wall portion, said first wall top fold line defining upper and lower inner wall portions on opposite sides of said first wall top fold line, said upper inner wall portion foldable outwardly from said formed container body portion along said first wall top fold line to form a shank portion extending along said first wall top fold line and generally perpendicular to said inner wall portion, said shank portion including a second fold line running generally parallel to said first top wall fold line between said first wall top fold line and the upper edge of said inner wall portion to define a bight portion outwardly of said second fold line on said shank portion, said shank portion forming an inner shank portion and said bright portion, with said inner shank portion being between said first and second fold lines, said bight portion foldable downwardly from said inner shank portion, said lower inner wall portion forming, with said bight and shank portions, a generally U-shaped hangar portion, with said inner shank portion positionable to rest upon said generally horizontally extending bedrail, said bight portion extending downwardly from said inner shank portion on one side of the generally horizontally extending bedrail, and said lower inner wall portion extending downwardly from said inner shank portion on the opposite side of the generally horizontally extending bedrail, said bight portion capable of extending towards said lower inner wall portion and being adhered thereto to provide for a wrap around the bedrail to provide a totally surrounding fit thereon, and to prevent the assemblable container from removal during routine usage, said bight and inner shank portions, when so configured, and assembled, being of sufficient body and thickness such that said hangar portion can maintain a generally U-shaped configuration for surrounding the bedrail, said bight and inner shank portions of said hangar portion dimensioned to be hangable upon a generally horizontal bedrail whose width is slightly less than the width of said inner shank portion with said hangar portion maintaining its configuration to surround a bedrail, a divider construction positionable within said interior compartment to form distinct compartments therein and to define an assembled container with separable storage areas, said outer wall, end and bottom portion on said sheet of material are interconnected to define a foldable template and said sheet of material is foldable, without complete separation of any of said layouts from said foldable template, to effect a unitary body construction as said container base body portion, and said foldable template also includes as a part thereof said divider construction, said unitary body construction including said divider construction forming a divider wall portion, formed by the folding of said foldable template.

2. The foldably assembleable container of claim 1 wherein said material sheet includes thereon as a distinct component separable from said sheet of material and said foldable template thereon to form a divider wall portion layout, said divider wall portion layout foldable to form said divider wall portion having a central portion of a defined width approximately equal to the width of the assembled container and outlying tabs along opposite sides of said central portion, said tabs foldable in opposite directions from said central portion and positionable for one of said tabs to be joined to said formed inner wall portion and for the other of said tabs to be joined to said formed outer wall portion.

3. The foldably assembleable container of claim 1 wherein said sheet of material is one of metal, polymer, or paperboard.

4. The foldably assembleable container of claim 1 further comprising a stiffener member insertable within a compartment of said formed container body portion to maintain the container in an expanded state with said defined end wall widths of said formed end wall portions disposed generally transverse to said formed inner and outer wall portions.

5. The foldably assembleable container of claim 4 wherein said stiffener member generally has the form of a parallelogram, with the bottom of said parallelogram positionable adjacent said formed bottom portion and the top of said parallelogram positioned at a height spaced above said formed bottom portion and below the height of said formed outer wall portion to form an elevated shelf within said compartment.

6. The foldably assembleable containers of claim 1 wherein said divider construction includes at least one divider wall portion positionable intermediately between said opposed formed end wall portions to extend between said formed inner and outer wall portions.

7. The hanging storage container of claim 1 further comprising:

said outer wall having similar length to said inner wall and greater height than said inner wall;

said bottom being of similar width as said end walls; and, said end walls having a generally trapezoidal shape.

8. The hanging storage container of claim 1 further comprising:

said outer wall being of similar height to said inner wall; and said bottom being of similar width as said shank, generally similar to the width of said end wall and including a flap of similar width as said bight for joining the exterior of said inner wall.

9. The device for storing items of claim 1 further comprising:

a stiffener box, having lesser height than said end wall, locating adjacent to said divider construction.

10. The device for storing items of claim 1 further comprising:

a shelf, generally parallel and spaced above said bottom, and locating adjacent to said divider wall portion.

* * * * *